US011843207B2

(12) United States Patent
Henrici et al.

(10) Patent No.: US 11,843,207 B2
(45) Date of Patent: Dec. 12, 2023

(54) LAMP SOCKET WITH NON-RIVETED CONTACT CONNECTION

(71) Applicant: BJB GmbH & Co. KG, Arnsberg (DE)

(72) Inventors: Philipp Henrici, Arnsberg (DE); Olaf Baumeister, Sundern (DE); Mark Weber, Arnsberg (DE)

(73) Assignee: BJB Gmbh & Co. KG, Arnsberg (DE)

( * ) Notice: Subject to any disclaimer, the term of this patent is extended or adjusted under 35 U.S.C. 154(b) by 0 days.

(21) Appl. No.: 17/699,127

(22) Filed: Mar. 20, 2022

(65) Prior Publication Data

US 2022/0376449 A1 Nov. 24, 2022

(30) Foreign Application Priority Data

May 18, 2021 (DE) ..... 102021112796.3

(51) Int. Cl.

| | |
|---|---|
| ***H01R 33/09*** | (2006.01) |
| ***H01R 13/11*** | (2006.01) |
| ***H01R 13/428*** | (2006.01) |
| ***H01R 33/94*** | (2006.01) |

(52) U.S. Cl.
CPC ..... *H01R 33/09* (2013.01); *H01R 13/112* (2013.01); *H01R 13/428* (2013.01); *H01R 33/94* (2013.01)

(58) Field of Classification Search
CPC .... H01R 33/09; H01R 13/112; H01R 13/428; H01R 33/94
See application file for complete search history.

(56) References Cited

U.S. PATENT DOCUMENTS

| | | | | |
|---|---|---|---|---|
| 4,804,343 | A | 2/1989 | Reedy | |
| 8,632,364 | B2 * | 1/2014 | Lee | H01R 33/975 439/619 |
| 9,222,658 | B2 * | 12/2015 | Midy | H01R 33/09 |

FOREIGN PATENT DOCUMENTS

| | | | |
|---|---|---|---|
| DE | 19860588 | A1 | 9/2000 |
| DE | 102006002667 | A1 | 8/2007 |
| EP | 0320875 | A2 | 6/1989 |

* cited by examiner

*Primary Examiner* — Oscar C Jimenez
*Assistant Examiner* — Paul D Baillargeon
(74) *Attorney, Agent, or Firm* — Von Rohrscheidt Patents

(57) ABSTRACT

A lamp socket for a cooking appliance lamp, the lamp socket including a socket body; at least one supply contact configured to connect to a connection conductor configured to supply electrical voltage electrical voltage to the cooking appliance lamp; at least one socket contact electrically connected with the at least one supply contact and connected to an illuminant socket of the cooking appliance lamp; a contact cavity formed by the socket body wherein the at least one socket contact is arranged in the socket cavity; a fastener that fastens the at least one supply contact at the socket body, wherein the fastener is integrally provided in one piece with the at least one supply contact or bonded to the supply contact.

10 Claims, 9 Drawing Sheets

LAMP SOCKET WITH NON-RIVETED CONTACT CONNECTION

RELATED APPLICATIONS

This application claims priority from German Patent Application DE10 2021 112 796.3 filed on May 18, 2021 which is incorporated in its entirety by this reference.

FIELD OF THE INVENTION

The invention relates to a lamp socket, in particular for cooking appliances.

BACKGROUND OF THE INVENTION

Generic lamp sockets of this type are well known in the art. They receive lamps according to various standards in particular with plug in sockets like G9 standard or threaded socket with E14 or E39 standards in order to illuminate e.g. interior spaces of cooking appliances. The socket is fixed e.g. by a metal support ring in a lamp recess of a wall of the cooking appliance and covered by a lamp glass. Typically, the lamp glass is arranged in a cooking cavity whereas the socket is arranged outside of the cooking cavity. A cooking appliance lamp of the generic type is described e.g. in DE 10 2006 002 667 A1 by applicant.

The socket includes two supply contacts at an end that is oriented away from the lamp glass or the lamp wherein the two supply contacts are configured to be connected to an external power supply and are provided with corresponding connection conductors.

The supply contacts are in turn connected with socket contacts that are arranged in a socket recess of the socket body and electrically connected with socket contacts of the lamp.

Generic lamp sockets are typically mass produced with a high level of automation in order to get production costs down wherein a socket design that lends itself to automated fabrication determines the economic success of sockets of this type.

BRIEF SUMMARY OF THE INVENTION

Thus, it is an object of the invention to simplify the generic lamp socket design and provide a correspondingly simple assembly method.

The object is achieved by a lamp socket for a cooking appliance lamp, the lamp socket including a socket body; at least one supply contact configured to connect to a connection conductor configured to supply electrical voltage electrical voltage to the cooking appliance lamp; at least one socket contact electrically connected with the at least one supply contact and connected to an illuminant socket of the cooking appliance lamp; a contact cavity formed by the socket body wherein the at least one socket contact is arranged in the socket cavity; a fastener that fastens the at least one supply contact at the socket body, wherein the fastener is integrally provided in one piece with the at least one supply contact or bonded to the supply contact.

The inventors have found that the known attachment of the supply contacts at the socket body can be improved. So far supply contacts are positioned at the socket body and thereafter attached at the socket body by a separate fastener, e.g. a rivet or a bolt. Typically, manual labor is required for correct positioning as well as for the actual attachment process. When the supply contact includes the fastener according to the invention, in particular when the fastener is an integral or bonded component of the supply contact an alignment of the fastener with the supply contact is not required so that this complex step which requires a highest level of precision, can be omitted. For example, it is conceivable that the supply contact includes a bonded rivet which is pressed into a rivet recess after positioning the supply contact at the socket body and thereafter the rivet is pressed into the rivet recess by a suitable tool. Thus, the rivet can disengage from the supply contact.

Therefore, the socket body includes an attachment contour that is engaged by the fastener.

It is furthermore proposed according to the invention that the socket contact is supported by the supply contact fixed at the socket body.

It is well known in the art, to attach the supply contact and the socket contact at the socket body using the same fastener, thus to position both contacts with respective rivet openings aligned and thereafter inserting the rivet or alternatively the attachment screw into the socket body for fixing. This, however, increases complexity since two contacts have to be positioned correctly. The solution according to the invention has the essential advantage that the supply contact positions the socket contact and only the supply contact is fixed at the socket body by the fasteners attached according to the invention, wherein the fasteners however arranges the socket contact at the socket body only indirectly.

The invention proposes furthermore that the supply contact is arranged in the contact cavity and accessible through an insertion opening of the contact cavity. This does not only increase reliability of the socket by making a contact of persons with the supply contacts more difficult in particular when the supply contacts are arranged within the contact cavity in their entirety. This type of socket design furthermore facilitates fixing the socket contact by the supply contact.

In particular the attachment contour is formed by the walls of the contact cavity and the fastener of the supply contact reaches behind the attachment contour.

This is facilitated by providing the fastener as an fastening arm that is connected at the supply contact and plastically deformable or spring elastic. For automated assembly it is particularly advantageous to provide spring elastic fastening arms that function as interlocking devices. Alternatively, it is conceivable to plastically deform the fastening arms using a tool after inserting the supply contacts into the socket body in particular into the contact cavity of the socket body so that the fastening arms reach behind a corresponding attachment contour.

Advantageously the attachment contour can be provided as a wall protrusion wherein the fastening arm reaches behind the wall protrusion.

In order to assure a reliable and advantageously designed fixing of the socket contact by the supply contact the contact cavity includes a first receiving cavity for the socket contact and a second receiving cavity for the supply contact wherein the first receiving cavity and the second receiving cavity share a common receiving section, in particular when the socket contact and the supply contact are arranged in a common receiving section and the socket contact is supported at the supply contact.

Fixing the socket contact by the supply contact is particularly advantageous when the socket contact and the supply contact are inserted along a common insertion direction through the insertion opening into the contact cavity and the socket contact is arranged upstream of the supply contact in the insertion direction.

The invention also relates to a new production method for a lamp socket according to the invention, in particular a method for a new and simplified fixing of the socket contact.

The invention also relates to a method for fixing a supply contact in a lamp socket, the method including:

a) interlocking a reset elastic fastener behind an attachment contour of the socket body, or b) deforming a plastically deformable fastener after aligning the supply contact with the attachment contour of the socket body so that the fastener reaches behind the attachment contour.

This method can be further improved by initially inserting the socket contact into the first receiver of the contact cavity in the insertion direction, thereafter inserting the supply contact into the second receiver of the contact cavity, wherein the socket contact and the supply contact are arranged in a common receiving section.

BRIEF DESCRIPTION OF THE DRAWINGS

Additional advantages of the invention can be derived from the subsequent description of an embodiments with reference to drawing figures, wherein.

DETAILED DESCRIPTION OF THE INVENTION

Figure 1:
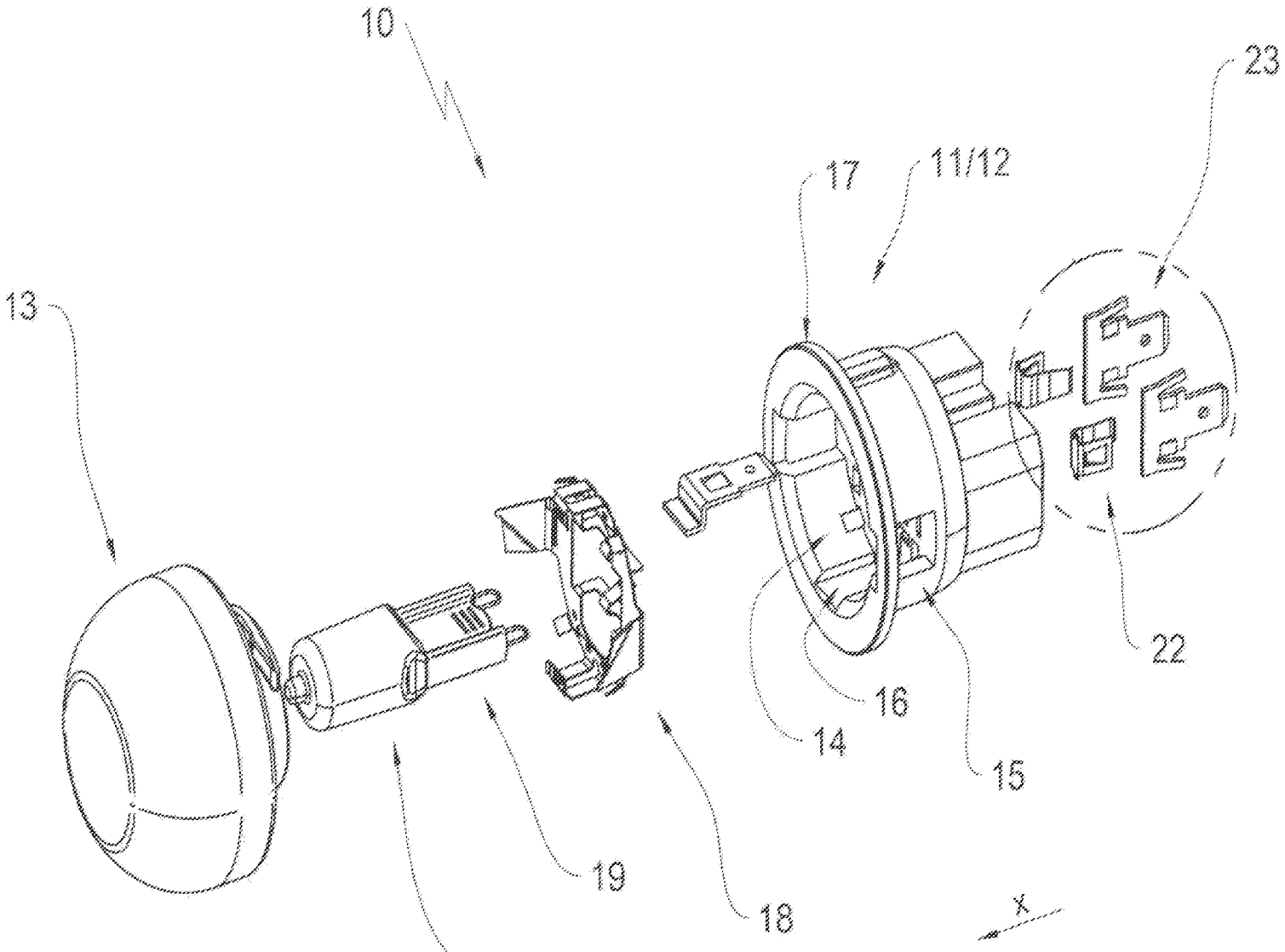
FIG. 1 illustrates a cooking appliance lamp with a lamp socket according to the invention.

The drawing figures show a cooking appliance lamp overall designated with reference numeral 10, wherein FIG. 1 shows an exploded view.

The cooking appliance lamp 10 illustrated in FIG. 1 includes a lamp socket 11 formed by a socket body 12 that forms a receiving recess 14 at a top side oriented towards a lamp glass 13. The receiving recess 14 is enveloped by a wall 15 and includes an insertion opening 16 that is enveloped by a mounting flange 17.

A support ring 18 that is insertable into the receiving recess 14 is configured to fix the socket 11 in a lamp recess of a cooking apparatus wall. The support ring 18 furthermore fixes the lamp glass 13 at the socket body 12 and provides a retaining spring that interlocks the illuminant socket 19 of a GR9 lamp in a socket recess of the socket body 12.

The socket body 12 forms two spouts 21 at a bottom side that is oriented away from the lamp glass 13, wherein the spouts respectively support a socket contact 22 and a supply contact 23.

Figure 2:
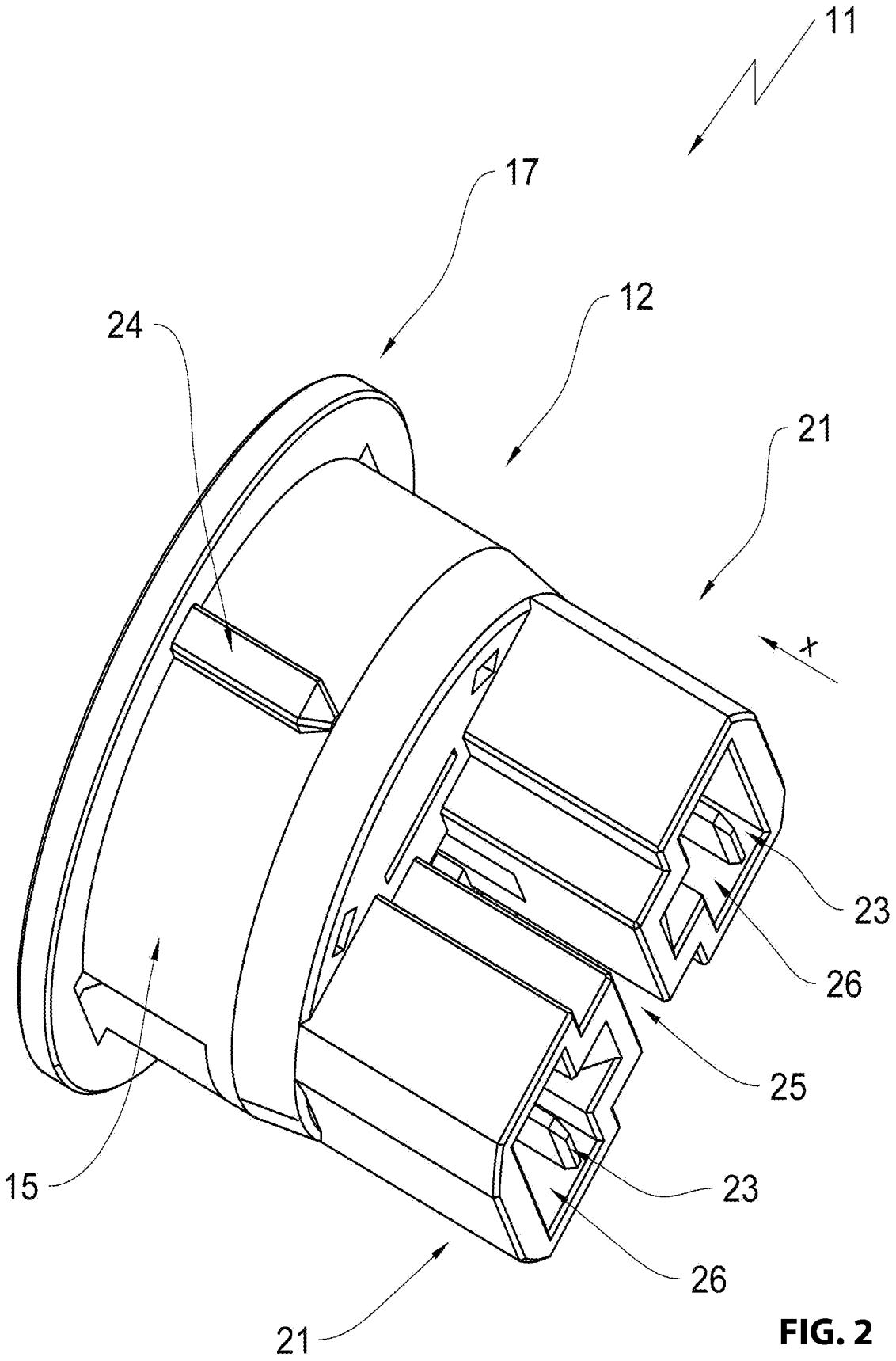
FIG. 2 illustrates a perspective view of the lamp socket according to FIG. 1.

FIG. 2 shows the lamp socket 11 in a perspective view of a bottom side. The wall 15 supports a centering rib 24 which arranges the lamp socket 11 in the cooking appliance in a correct orientation.

The spouts 21 of the socket body 12 are separated from each other by a ventilation spout 25 and respectively include a contact cavity 26. Each contact cavity 26 is accessible through an insertion opening 27 through which a respective socket contact 22 and a respective supply contact 23 are introducible in the insertion direction X into the respective contact cavity 26.

In the embodiment the insertion openings 27 are arranged on a bottom side of the socket body 12. The insertion direction X is oriented towards the lamp glass 12. This is an advantageous and embodiment, however, different orientations of the insertion's openings 27 of the respective spout 21 are conceivable which then also changes the orientation of the insertion direction X.

Figure 3:
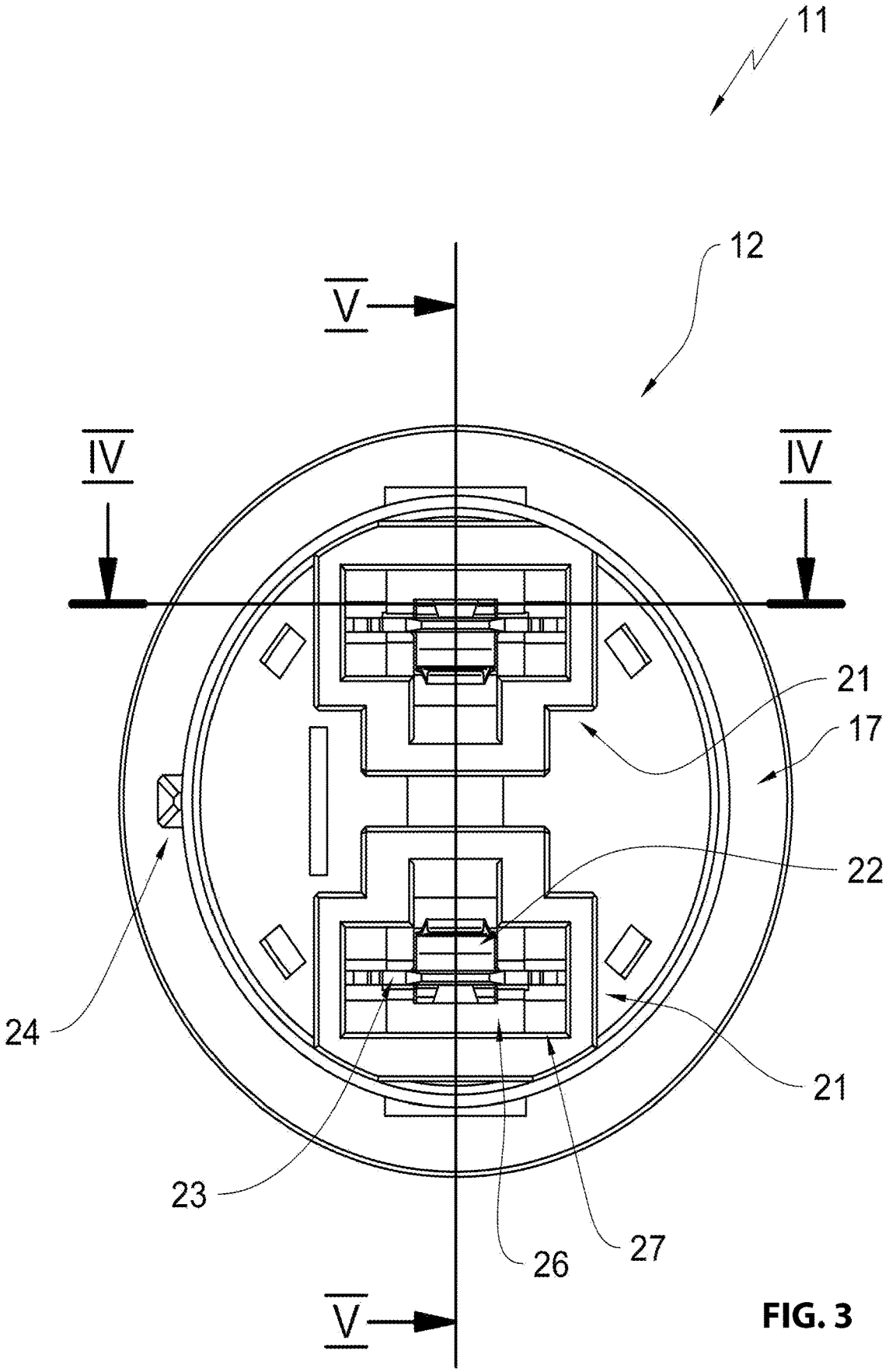
FIG. 3 illustrates a view of the lamp socket from below, thus in insertion direction of the socket contact.

FIG. 3 shows the lamp socket 11 in a view from below, thus in the insertion direction X. The insertion openings 27 of the contact cavities 26 can be derived from this illustration among other things. Furthermore, this representation facilitates a view into the contact cavities 26, showing the supply contact 23 inserted into each contact cavity and the socket contact 22 also inserted therein.

Figure 1B:
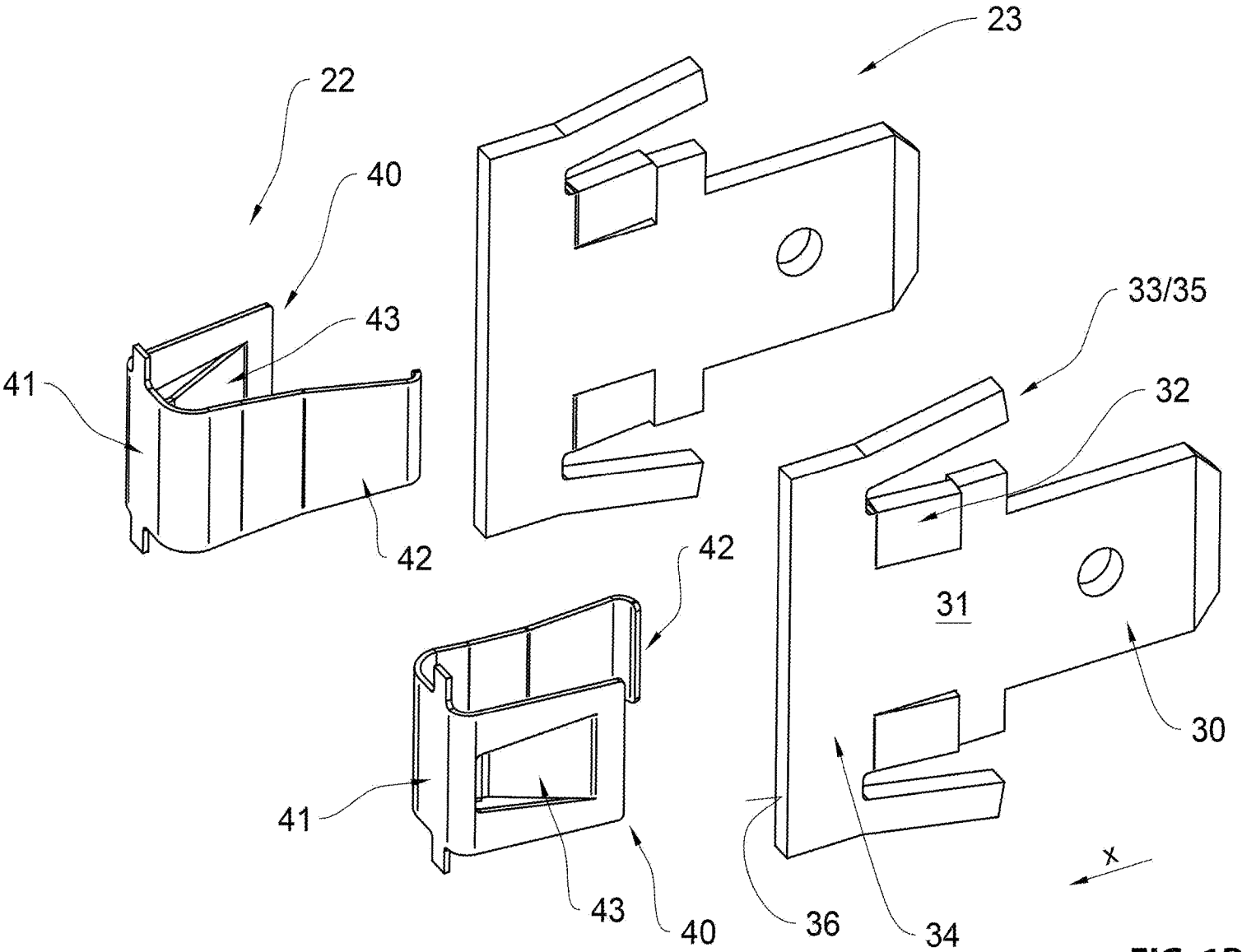
FIG. 1B illustrates a representation of the arrangement of the socket- and supply contacts according to FIG. 1

FIG. 1B shows the arrangement of the socket contacts 22 inserted into the spout 21 and the supply contacts 23 in a blown-up representation. Each supply contact 22 includes a flat plug connector 30 at an end arranged proximal to the insertion opening. A clamping section 31 adjoins the flat plug connector in the insertion direction X, thus in a direction towards the lamp glass 13 wherein clamping lugs 32 are bent out of the clamping section. A contact section 34 is arranged upstream in the clamping section wherein the contact section supports two fasteners 33 configured as fastening arms 25 that are arranged opposite to each other and receive the clamping section 31 between each other. Thus, the fastening arm 35 extends from the contact section 34 against the insertion direction X towards a bottom side of the socket body 12 or towards the flat plug connector 30. The face 36 of the supply contact 23 oriented towards the lamp glass 13 or that is upstream in the insertion direction functions as a support structure to fix the socket contact 22.

The supply contact 23 is a stamped component that is essentially flat in the instant embodiment. The clamping lugs 32 are stamped at a right angle to the flat sides. The fastening arms are oriented at an angle relative to the stamping edges in FIG. 1B.

The socket contact 22 is a stamped component as well and has a U-shaped or C-shaped contour in cross section. A first contact arm 40 is connected with a second contact arm 42 through a support arm 41 wherein free ends of the first contact arm 40 and of the second contact arm 42 extend against the insertion direction X towards the insertion opening 27 of the spouts 21, thus in a direction towards a bottom side of the socket body 12.

The first contact arm 40 includes a contact pressure spring 43, that is angled out of the contact arm material and bent spring elastic in a direction towards the second contact arm 42, thus into the interior of the U-shaped socket contact 22.

The second contact arm 42 of the socket contact 22 is bent spring elastic away from the contact arm 40, thus in the same direction thus in the contact pressure spring 43.

Figure 7:
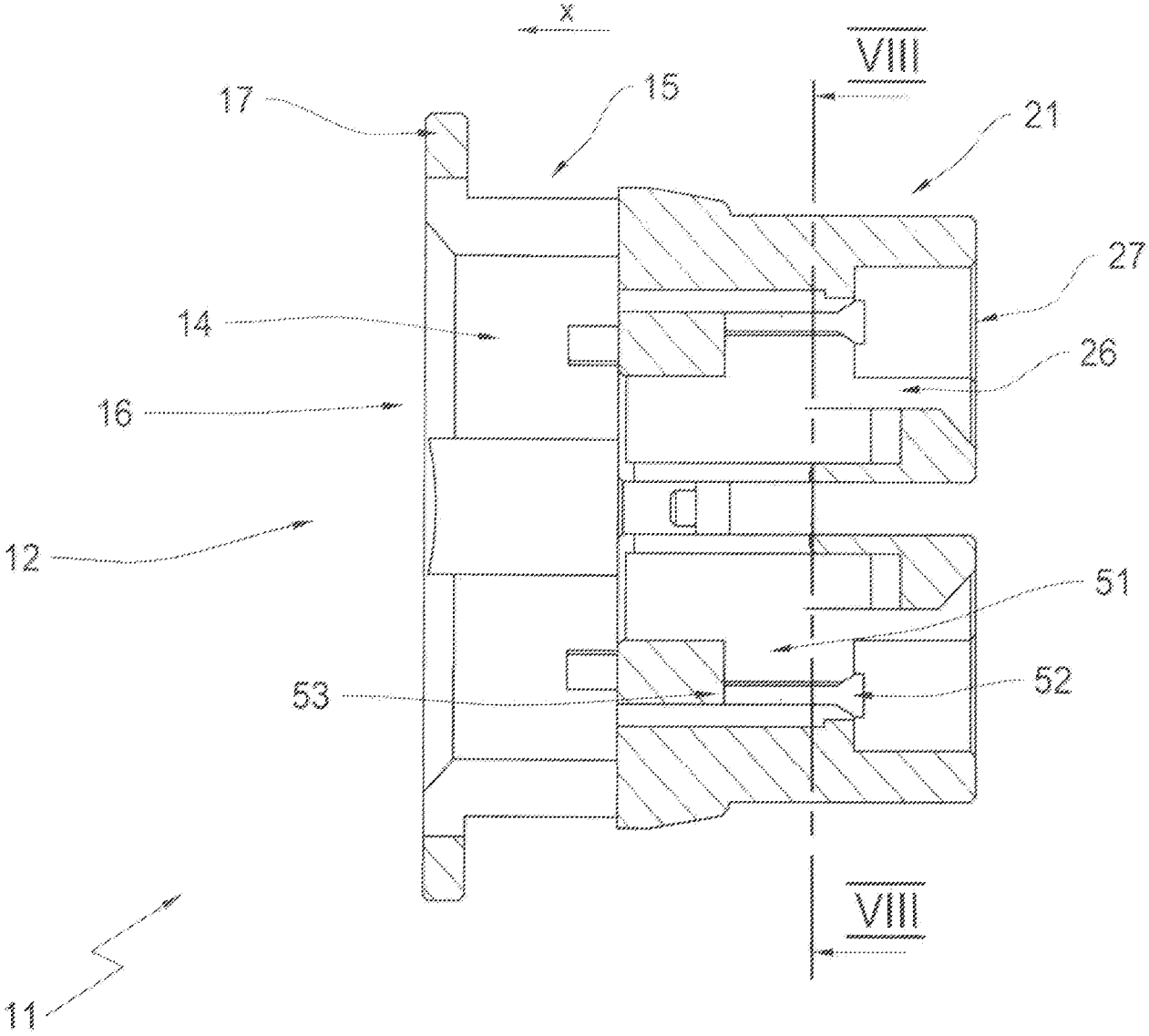
FIG. 7 illustrates the sectional view of the socket body according to FIG. 5 without showing the socket and supply contacts.

FIG. 7 shows the socket body 12 in a vertical sectional view according to sectional line V-V in FIG. 3, wherein initially also a representation of the inserted socket contacts 22 and of the inserted supply contacts 23 is omitted.

As described supra each spout 21 forms a contact cavity 26 that is accessible through an insertion opening 27. Within each contact cavity 26 there is a first receiving cavity 50 and a second receiving cavity 51. The first receiving cavity 50 runs through the contact cavity 26 configured as a slot 52 that extends diametrically through the contact cavity 26, wherein the slot is open opposite to the insertion cavity X, thus in a direction towards the insertion opening 27. The second receiving cavity is arranged between the slot ends and shares a common receiving section 53 with the first receiving cavity 50.

Figure 8:
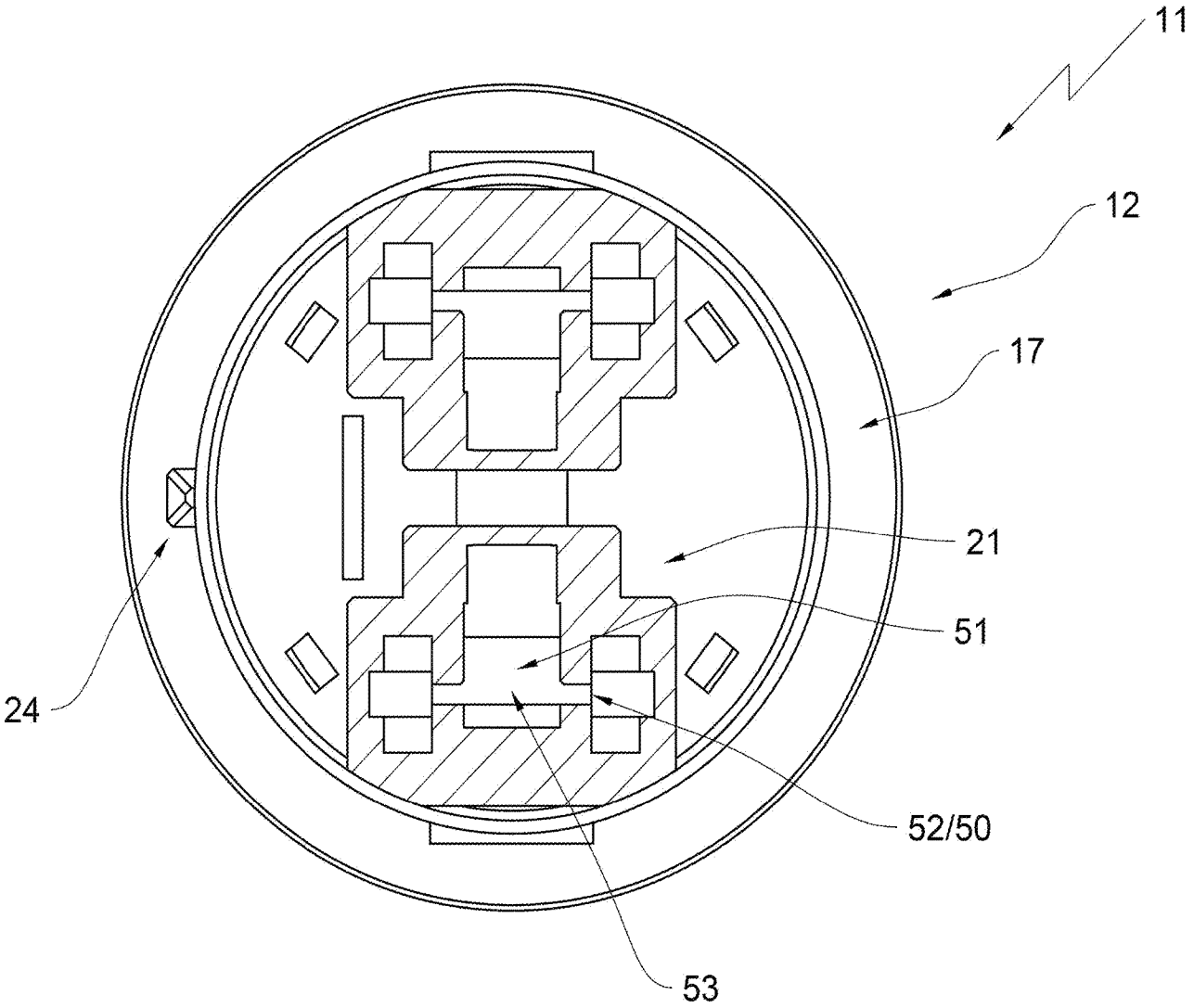
FIG. 8 illustrates a sectional view according to the sectional line VIII-VIII of FIG. 7.

The position of the receiving cavities 50, 51 in the spouts 21 of the socket body 12 is shown in FIG. 8 which is a sectional view according to the sectional line VIII-VIII in FIG. 7. The slot shaped first receiving cavity 50 runs through the second receiving cavity 51. The common receiving cavity 53 is created where both receiving cavities overlap. In the common receiving cavity 53 the face 36 contacts the support arm 41 when the socket and supply contacts 22, 23 are inserted. The arrangement of socket contact and the supply contact 23 in the receiving cavities 50 51 then corresponds to the contact arrangement shown in FIG. 3.

Figure 5:
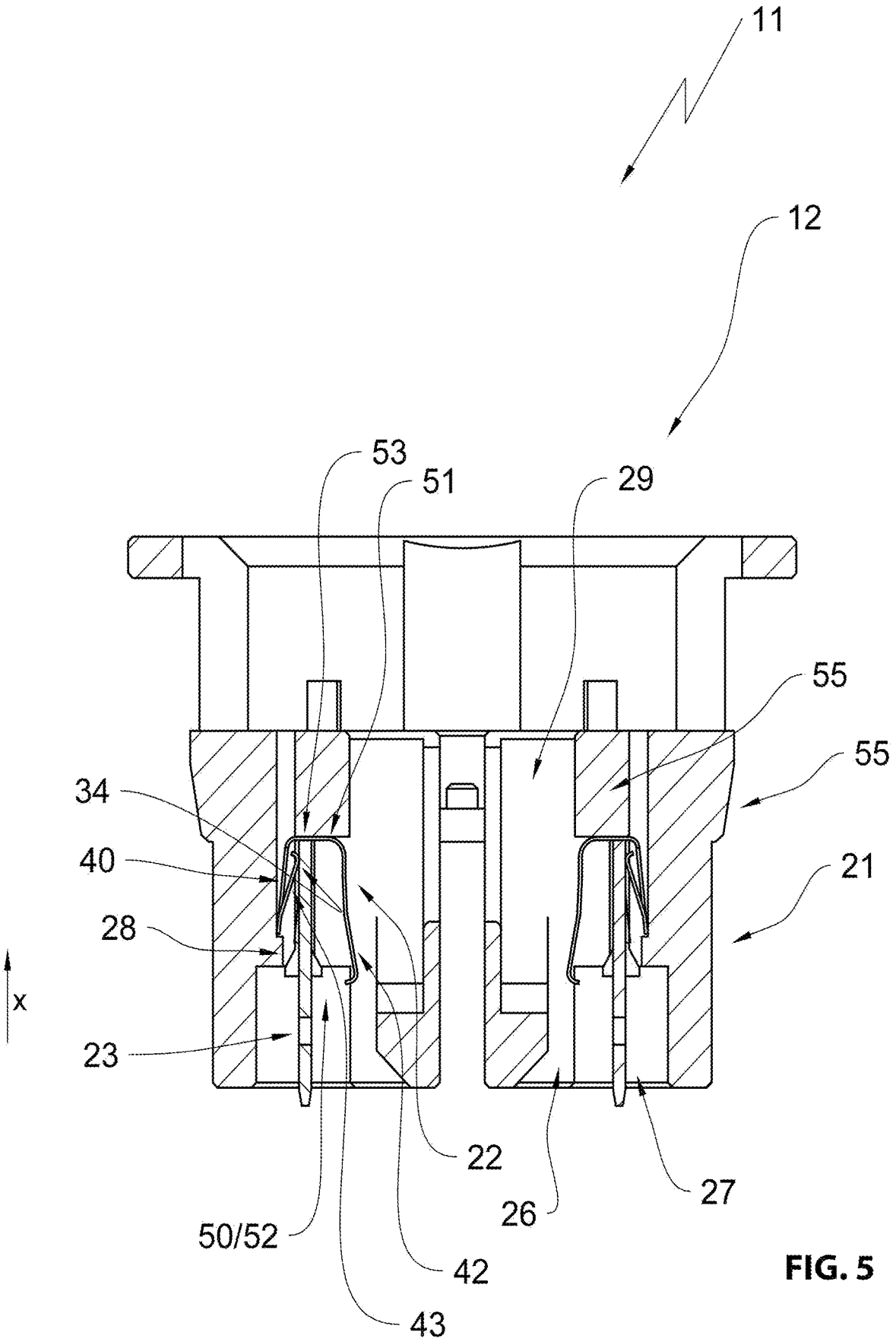
FIG. 5 illustrates a sectional view of the lamp socket according to the sectional line V-V in FIG. 3.

FIG. 5 shows sectional view according to FIG. 7 with socket and supply contacts 22, 23 inserted into a respective contact cavity 26 of each spout 21. From this representation it is evident that the socket contact 22 initially has to be introduced into the second receiving cavity 51 in an insertion direction X into the socket body 12. Thus, the free end of the first contact arm 40 reaches behind a protruding support lug 28 that is formed by the wall of the contact cavity 26, whereas the free end of the second contact arm 42 is supported at a wall section that is not visible in FIG. 5. The socket contact 23 is thus fixed in a preliminary manner which prevents unintentional sliding the socket contact from the socket body 12 during assembly.

Thereafter the supply contact 23 is inserted into the first receiving cavity 50, thus the slot 52. The insertion movement of the supply contact 23 in the insertion direction X, terminates when the face 36 contacts an inside of the support arm 51 of the socket contact 22, which is arranged in the common receiving section 53 of the first receiving cavity 50 and the second receiving cavity 51. The contact spring 43 contacts the contact section 34 of the supply contact 23 and provides the required electrical contacting between socket contact 22 and supply contact 23. The second contact arm 42 of the socket contact 22 is arranged in the socket receiver 29 of the socket body 12 so that the socket contacts of a lamp, in this embodiment of a G9 lamp 20 can electrically contact the socket contact and the supply contact of the socket body.

Figure 6:
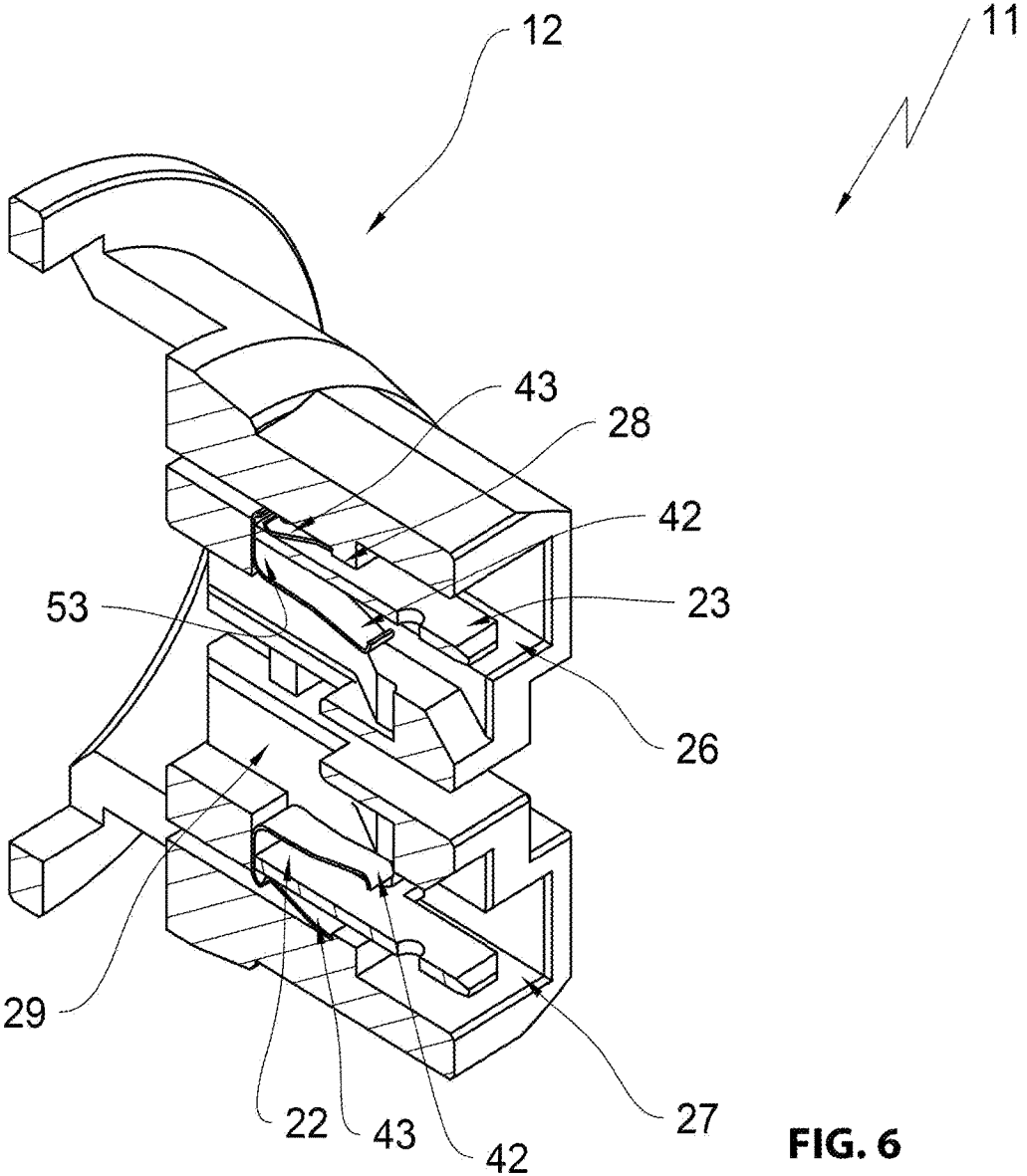
FIG. 6 illustrates the representation according to FIG. 5 in a perspective view.

This is also illustrated again in FIG. 6 which shows the socket body 12 cut according to FIG. 5 in a perspective sectional view.

The preceding description together with the drawing figures in particular FIGS. 5-7 clearly shows that a fixing of the supply contact 23 in the socket body 12 leads to an attachment of the socket contact 22 through the supply contact 23 in the socket body 12. Thus, the socket contact 12 is only indirectly fixed by the fasteners 33 of the supply contact 23.

The attachment of the supply contact 23 at the socket body 12 is now described with reference to FIG. 4.

Figure 4:
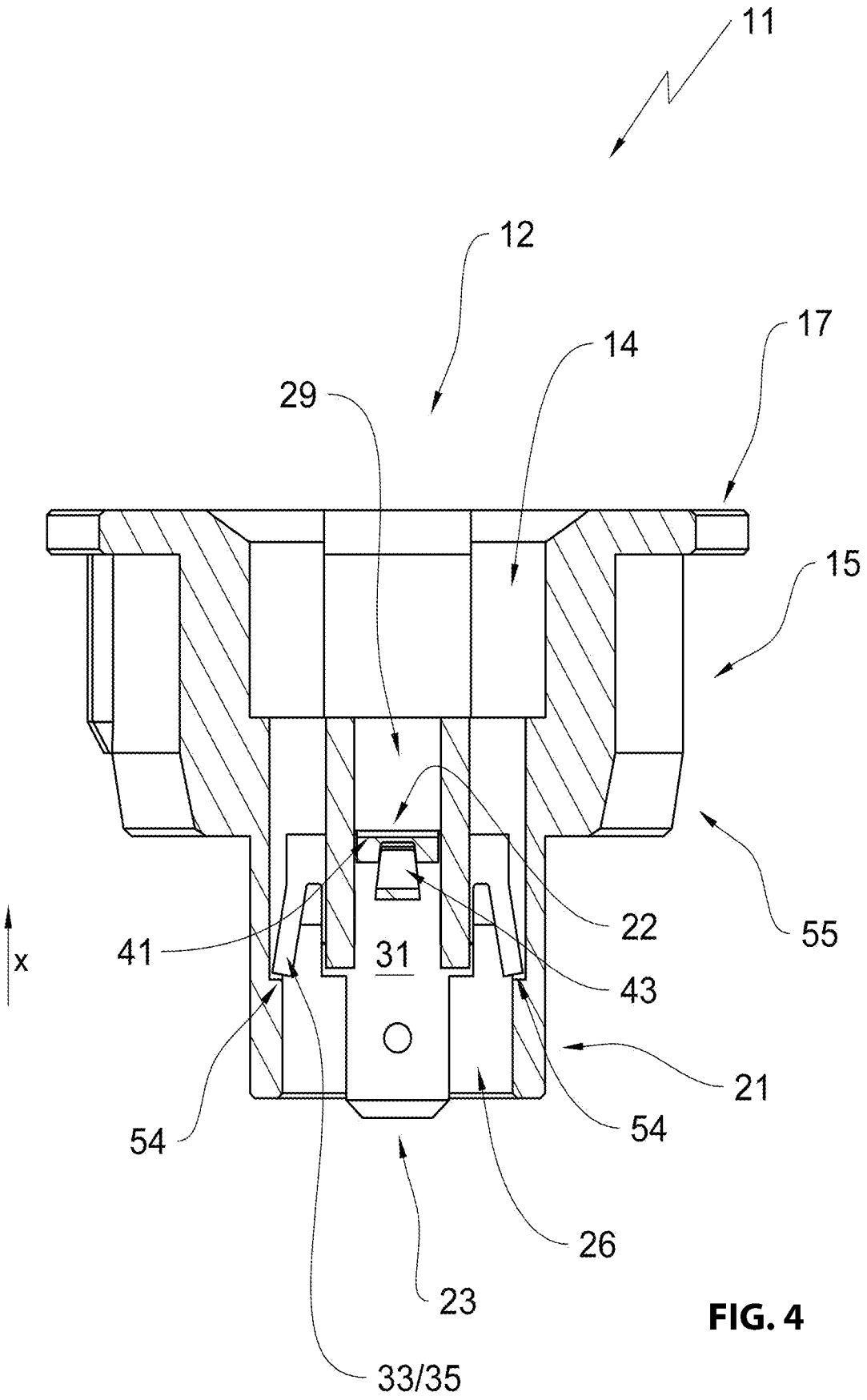
FIG. 4 illustrates a sectional view of the lamp socket according to the sectional line IV-IV in FIG. 3.

FIG. 4 shows the socket body 12 including inserted contacts according to the sectional line IV-IV in FIG. 3.

The supply contact 23 is inserted in the insertion direction X into the contact cavity 26 of the spout 21 and contacts the socket contact 22 and contacts the support arm 41 of the socket contact 22 with its face 36 and supports the socket contact in the second receiving cavity 51. The fastening arms 35 of the supply contact 23 reach behind an attachment contour formed by the contact cavity wall and configured as a wall protrusion 54 due to a lateral spreading of the fastening arms 35 that are oriented towards the contact cavity wall.

A socket base 55 that is formed by the socket body 12 functions as a movement stop in the insertion direction X that defines the contact cavities 26 in the insertion direction X as shown in FIG. 5.

When the fastening arms 35 are fasteners that are spread spring elastic outward thus in a direction towards the contact cavity wall the fasteners are initially displaced inward during insertion of the supply contact 23 into the respective spout 21 until they have slid past the wall protrusion 54. The spring elasticity of the material then leads to a spreading movement into the starting position so that the fastening arms 35 reach behind the wall protrusion 54 so that a pull-out movement of the supply contact 23 against the insertion direction X out of the socket body 12 is reliably prevented.

However, when the fasteners are configured as plastically deformable fastening arms they are oriented in a straight line, this means un-spread against the insertion direction X or in a direction towards the flat plug 30 before the assembly of the supply contact 23 is completed. After inserting the supply contact 23 into the contact cavity 26, a forming tool is inserted between the respective fastening arm 35 and the clamping section 31 arranged between the fastening arms 35, which spreads the fastening arms 35 outward performing a plastic deformation until the fastening arms reliably reach behind the wall protrusion 54 and reliably prevent a pull back movement of the supply contact 23 against the insertion direction X.

REFERENCE NUMERALS AND DESIGNATIONS

10 cooking appliance lamp
11 lamp socket
12 socket body
13 lamp glass
14 receiving recess
15 wall
16 insertion opening
17 mounting flange
18 support ring
19 illuminant socket
20 G9 lamp
21 spout
22 socket contact
23 supply contact
24 centering rib
25 ventilation gap
26 contact cavity
27 insertion opening
28 support lug
29 socket receiver
30 flat plug connector
31 clamping section
32 clamping lug
33 fastener
34 contact section
35 fastening arm
36 face
40 first contact arm
41 support arm

42 second contact arm
43 contact pressure spring
50 first receiving cavity
51 second receiving cavity
52 slot
53 common receiving section
54 wall protrusion, attachment contour
X insertion direction

What is claimed is:

1. A lamp socket for a cooking appliance lamp, the lamp socket comprising:

a socket body;

at least one supply contact configured to connect to a connection conductor configured to supply electrical voltage electrical voltage to the cooking appliance lamp;

at least one socket contact electrically connected with the at least one supply contact and connected to an illuminant socket of the cooking appliance lamp;

a contact cavity formed by the socket body wherein the at least one socket contact is arranged in the socket cavity;

a fastener that fastens the at least one supply contact at the socket body, wherein the fastener is integrally provided in one piece with the at least one supply contact, wherein the socket body includes an attachment contour that is engaged by the fastener wherein the at least one socket contact and the at least one supply contact are two discrete metal components and the at least one socket contact is supported by the at least one supply contact fixed at the socket body, wherein the at least one supply contact is a flat metal component extending in a plane and wherein the fastener is configured as at least one fastening arm integrally formed at the supply contact extending in the plane at an angle relative to the at least one supply contact and spring elastic and plastically deformable in the plane.

2. The lamp socket according to claim 1, wherein the at least one supply contact is arranged in a contact cavity and accessible through an insertion opening of the contact cavity.

3. The lamp socket according to claim 2, wherein the attachment contour is formed by walls of the contact cavity and the fastener of the at least one supply contact interlocks behind the attachment contour.

4. The lamp socket according to claim 2, wherein the contact cavity includes a first receiving space for the at least one socket contact and a second receiving space for the at least one supply contact, and wherein the first receiving cavity and the second receiving cavity share a common receiving section.

5. The lamp socket according to claim 2, wherein the at least one socket contact and the at least one supply contact are arranged in the common receiving section.

6. The lamp socket according to claim 5, wherein the at least one socket contact and the at least one supply contact are inserted in a common insertion direction through an insertion opening into the contact cavity and the at least one socket contact is arranged downstream of the supply contact in the insertion direction.

7. A method for fixing the at least one socket contact in the lamp socket according to claim 6, the method comprising:

initially inserting the at least one socket contact into the first receiving space of the contact cavity in the insertion direction, thereafter inserting the at least one supply contact into the second receiving space of the contact cavity, wherein the at least one socket contact and the at least one supply contact are arranged in the common receiving section.

8. The lamp socket according to claim 1, wherein the attachment contour is configured as a wall protrusion wherein the at least one fastening arm reaches behind the wall protrusion.

9. A method for fixing the at least one socket contact in the lamp socket according to claim 1, the method comprising:

interlocking the spring fastener between the attachment contour of the socket body, or deforming the plastically deformable fastener after aligning the at least one supply contact with the attachment contour of the socket body so that the plastically deformable fastener interlocks behind the attachment contour.

10. The lamp socket according to claim 1, wherein the socket body includes a receiving recess at a top side of the socket body that is oriented towards a lamp glass, and wherein a support ring is inserted into the receiving recess and configured to support the socket body in a lamp recess of a cooking cavity wall.

* * * * *